US006830471B2

(12) United States Patent
Okita et al.

(10) Patent No.: US 6,830,471 B2
(45) Date of Patent: Dec. 14, 2004

(54) ELECTRICAL CONTACT WITH ARCUATE CONTACT PORTION

(75) Inventors: Masao Okita, Furukawa (JP); Hsiu-Yuan Hsu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/457,921

(22) Filed: Jun. 9, 2003

(65) Prior Publication Data

US 2004/0102106 A1 May 27, 2004

(30) Foreign Application Priority Data

Nov. 22, 2002 (TW) ..... 91218818 U

(51) Int. Cl.[7] ..... H01R 4/50; H01R 13/625
(52) U.S. Cl. ..... 439/342; 439/857; 439/884
(58) Field of Search ..... 439/342, 263, 439/856–857, 884

(56) References Cited

U.S. PATENT DOCUMENTS 5,092,789 A * 3/1992 Sinclair ..... 439/259
5,797,774 A * 8/1998 Kaneko ..... 439/857
6,267,615 B1 * 7/2001 Lin ..... 439/342
6,319,038 B1 11/2001 Howell et al. ..... 439/342
6,450,826 B1 * 9/2002 Howell et al. ..... 439/342
6,461,183 B1 * 10/2002 Ohkita et al. ..... 439/342
6,478,637 B1 * 11/2002 Ohkita et al. ..... 439/857
6,537,095 B1 * 3/2003 Azuma ..... 439/342
6,558,182 B1 * 5/2003 Ohkita et al. ..... 439/342
6,565,368 B1 * 5/2003 Liao et al. ..... 439/83
6,638,119 B1 * 10/2003 Chang ..... 439/857
6,692,265 B2 * 2/2004 Kung et al. ..... 439/68

* cited by examiner

*Primary Examiner*—Michael C. Zarroli
(74) *Attorney, Agent, or Firm*—Wei Te Chung

(57) ABSTRACT

An electrical contact (1) includes a medial portion (10), two upper arm portions (11), and a lower solder portion (12). The medial portion includes two sidewalls (100), and an engaging portion (101) below one sidewall. The solder portion depends from the engaging portion. Each arm portion extends from a top of a respective sidewall, and is deflectable from a rest position to a deflected position by a corresponding horizontally actuatable mating pin (2). Each arm portion includes a top contact portion (110), and a guiding portion (111) extending obliquely from an end of the contact portion. The guiding portion has an inner convex side (1112) and a bottom edge (1110). The contact portion also has an inner convex side (1101). As each arm portion is deflected from the rest position to the deflected position, the pin contacts a contact section of the arm portion located above the bottom edge.

7 Claims, 4 Drawing Sheets

ELECTRICAL CONTACT WITH ARCUATE CONTACT PORTION

BACKGROUND OF THE INVENTION

1. Field of the Invention

The present invention relates to electrical contacts, and particularly to electrical contacts used in electrical connectors for connecting electronic packages such as pin grid array (PGA) central processing units (CPUs) with circuit substrates such as printed circuit boards (PCBs).

2. Description of the Prior Art

Zero insertion force, low actuation force connectors are widely used for electrically connecting PGA CPUs with PCBs. Usually, these connectors comprise an insulative base and a plurality of contacts received in the base. Examples of such connectors are disclosed in U.S. Pat. No. 6,319,038 and TW Patent Issue No. 472962. Referring to FIGS. 3 and 4, each contact 6 comprises a medial portion 60, a solder portion 62 depending from the medial portion 60, and a pair of arm portions 61 extending upwardly from the medial portion 60. The medial portion 60 has a U-shaped horizontal cross-section. The medial portion 60 comprises a pair of sidewalls 600 parallel to each other, and an engaging member 601 below one of the sidewalls 600. The engaging member 601 has several protrusions, for engaging with an insulative base (not shown) and thereby mounting the contact 6 in the base. The solder portion 62 extends downwardly from a bottom of the engaging member 601, for electrically connecting with a PCB (not shown). Each arm portion 61 extends upwardly from a top of a respective sidewall 600, thereby defining a first line 602 at a junction of the sidewall 600 and the arm portion 61. The arm portions 61 are bent obliquely toward each other, and are each deflectable from a rest position to a deflected position (as depicted with broken lines in FIG. 4) by a corresponding horizontally actuatable pin 8 of a CPU. Each arm portion 61 comprises a contact portion 610 at a top end thereof, and guiding portion 611 extending obliquely from an end of the contact portion 610. The contact portions 610 of the arms 61 are parallel to each other, and define a first distance therebetween. A second line 613 is defined at a bottom edge of each contact portion 610 and its adjacent guiding portion 611. The guiding portions 611 of the arms 61 extend obliquely away from each other, thereby defining a second maximum distance therebetween. The second distance is greater than the first distance.

Referring particularly to FIG. 4, in use, the pin 8 is inserted into a space between the free ends of the guiding portions 611. The second distance is greater than a diameter of the pin 8. Accordingly, the pin 8 is inserted with zero insertion force as between the contact 6 and the pin 8, and each arm portion 61 remains in the rest position. Then the pin 8 is moved horizontally toward the contact portions 610. Opposite side portions of a leading periphery of the pin 8 eventually contact insides of the guiding portions 611, whereupon an actuation force is applied to drive the pin 8 further. Finally, the pin 8 is received between the contact portions 610. During driving of the pin 8, a desired radius of leverage corresponding to the actuation force is represented by distance 'b'. However, in fact, as can be seen from the broken lines of FIG. 4, when the pin 8 contacts the insides of the guiding portions 611, the arm portions 61 deflect outwardly with respect to the first lines 602 toward respective deflected positions. The pin 8 contacts a contact point of each guiding portion 611 which is located on the second line 613, and the radius of leverage corresponding to the actuation force is in fact distance 'b prime' ('b'). Thus, the actuation force required to drive the pin 8 into the contact 6 is greater than desired.

In view of the above, a new electrical contact that overcomes the above-mentioned disadvantages is desired.

SUMMARY OF THE INVENTION

Accordingly, an object of the present invention is to provide an electrical contact used in an electrical connector, whereby friction between the contact and a corresponding mating pin is minimized.

Another object of the present invention is to provide an electrical contact used in an electrical connector, whereby minimal actuation force is required to drive a corresponding mating pin into engagement with the contact.

To achieve the above-mentioned objects, an electrical contact in accordance with a preferred embodiment of the present invention is used in an electrical connector. The contact is for engaging with a corresponding horizontally actuatable pin of a CPU. The contact comprises a medial portion, a pair of arm portions extending from a top of the medial portion, and a solder portion depending from a bottom of the medial portion. The medial portion comprises an engaging portion for engaging with an insulative base of the connector. The solder portion depends from a bottom of the engaging portion, for engaging with a PCB. Each arm portion is deflectable from a rest position to a deflected position by the pin. Each arm portion comprises a contact portion at a top end thereof, and a guiding portion extending obliquely from an end of the contact portion. The guiding portion comprises an inner convex side and a bottom edge. The contact portion also has an inner convex side. As each arm portion is deflected from the rest position to the deflected position, the pin contacts a contact section of the arm portion, the contact section being located above the bottom edge.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
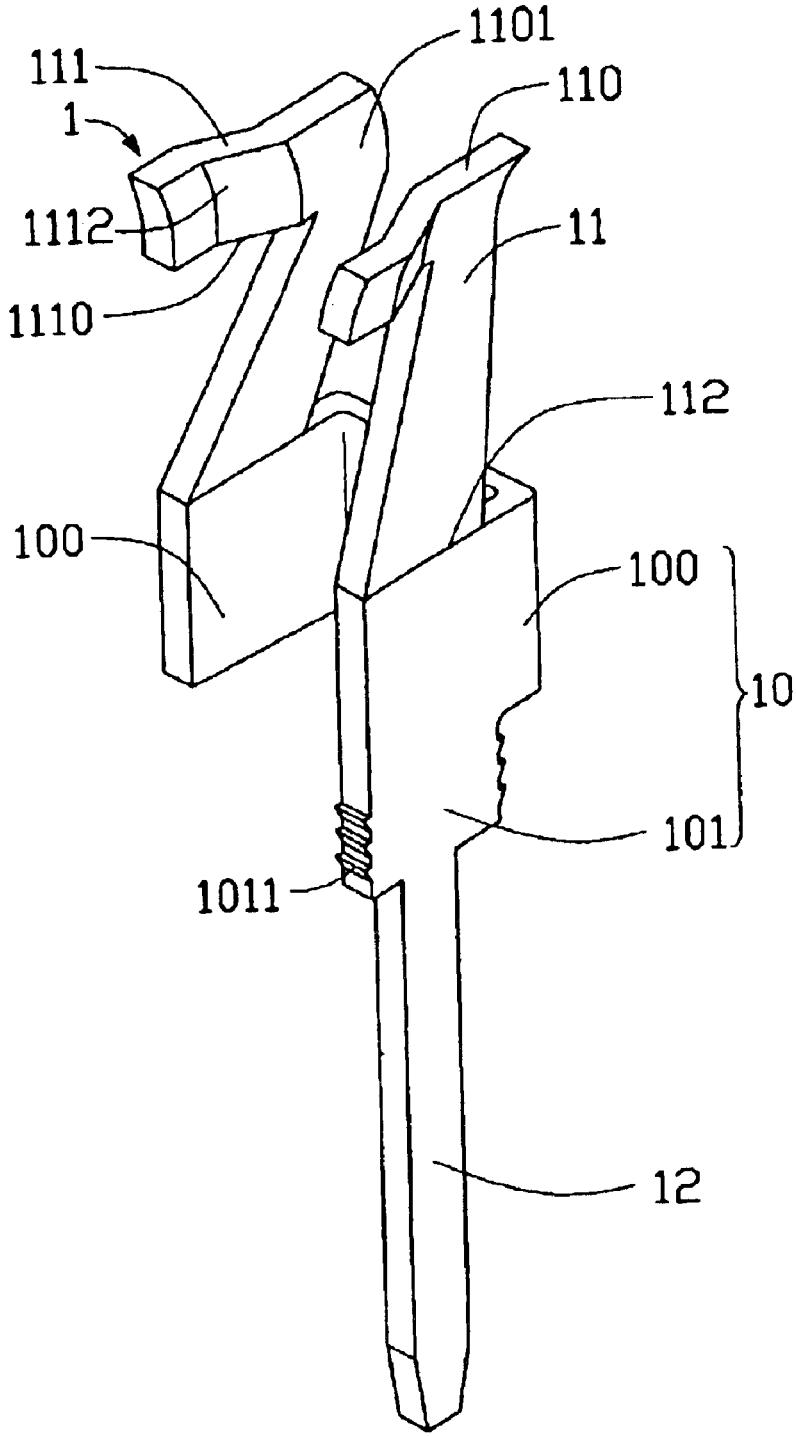
FIG. 1 is an isometric view of an electrical contact for an electrical connector in accordance with the preferred embodiment of the present invention.
Figure 2:
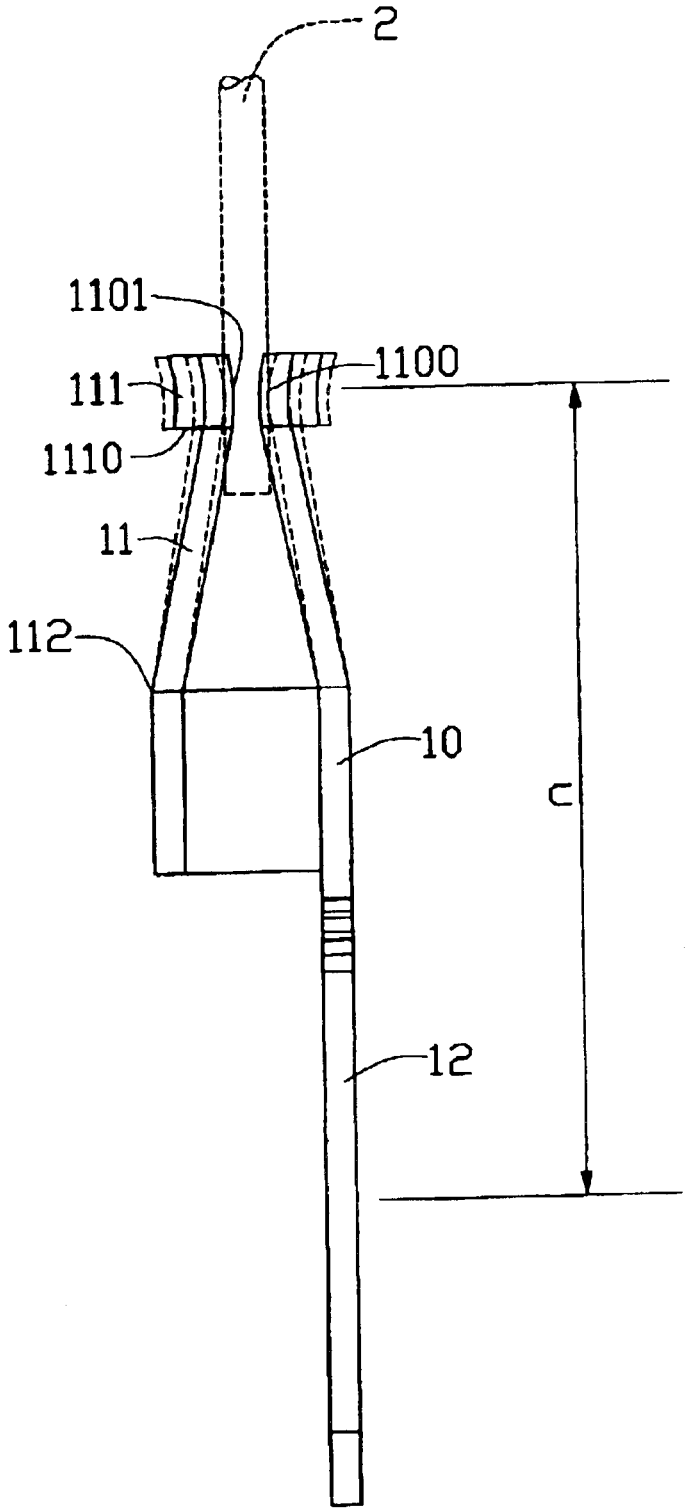
FIG. 2 is a front side plan view of the electrical contact of FIG. 1, showing a corresponding mating pin (represented by broken lines) of a CPU engaging with the contact.
Figure 3:
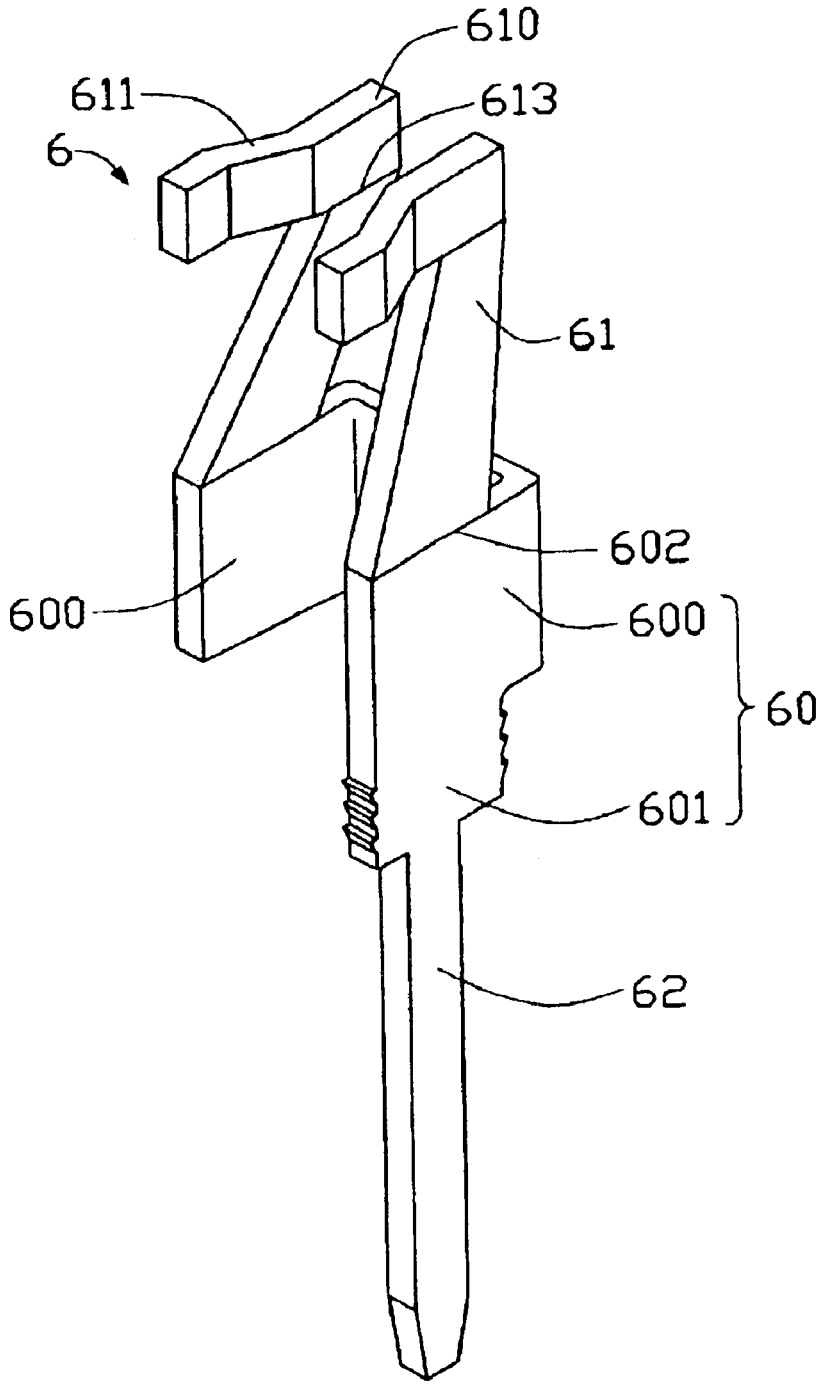
FIG. 3 (PRIOR ART)
FIG. 3 is an isometric view of a conventional electrical contact.

Referring to FIGS. 1 and 2, an electrical contact 1 of the present invention is used in an electrical connector (not shown). The electrical connector is for electrically connecting an electronic package such as a pin grid array (PGA)

central processing unit (CPU) with a circuit substrate such as a printed circuit board (PCB). The CPU comprises a plurality of horizontally actuatable pins 2 (only one shown). The electrical connector has an insulative base (not shown) for receiving a plurality of the contacts 1 therein.

Each contact 1 is stamped and formed from a metallic sheet. The contact 1 comprises a medial portion 10, a pair of arm portions 11 extending from a top of the medial portion 10, and a solder portion 12 depending from a bottom of the medial portion 10. The medial portion 10 has a U-shaped horizontal cross-section. The medial portion 10 comprises two parallel sidewalls 100, and an engaging portion 101 below one of the sidewalls 100. The engaging portion 101 comprises several protrusions 1011, for engaging with the base and thereby mounting the contact 1 in the base. The solder portion 12 depends from a bottom of the engaging portion 101, for electrically connecting with the PCB. Each arm portion 11 extends from a top of a respective sidewall 100, thereby defining a first line 112 at a junction of the sidewall 100 and the arm portion 11. The arm portions 11 are bent obliquely toward each other, and are each deflectable from a rest position to a deflected position (as depicted with broken lines in FIG. 2) by a corresponding pin 2. Each arm portion 11 comprises a contact portion 110 at a top end thereof, and a guiding portion 111 extending obliquely from an end of the contact portion 110. The guiding portions 111 of the arm portions 11 extend obliquely away from each other. Each guiding portion 111 comprises an inner convex side 1112, and a bottom edge 1110. The contact portion 110 also comprises an inner convex side 1101. The contact portions 110 of the arm portions 11 define a first minimum distance therebetween. The guiding portions 111 of the arm portions 11 define a second distance between respective free ends thereof. The second distance is greater than the first distance.

Figure 4:
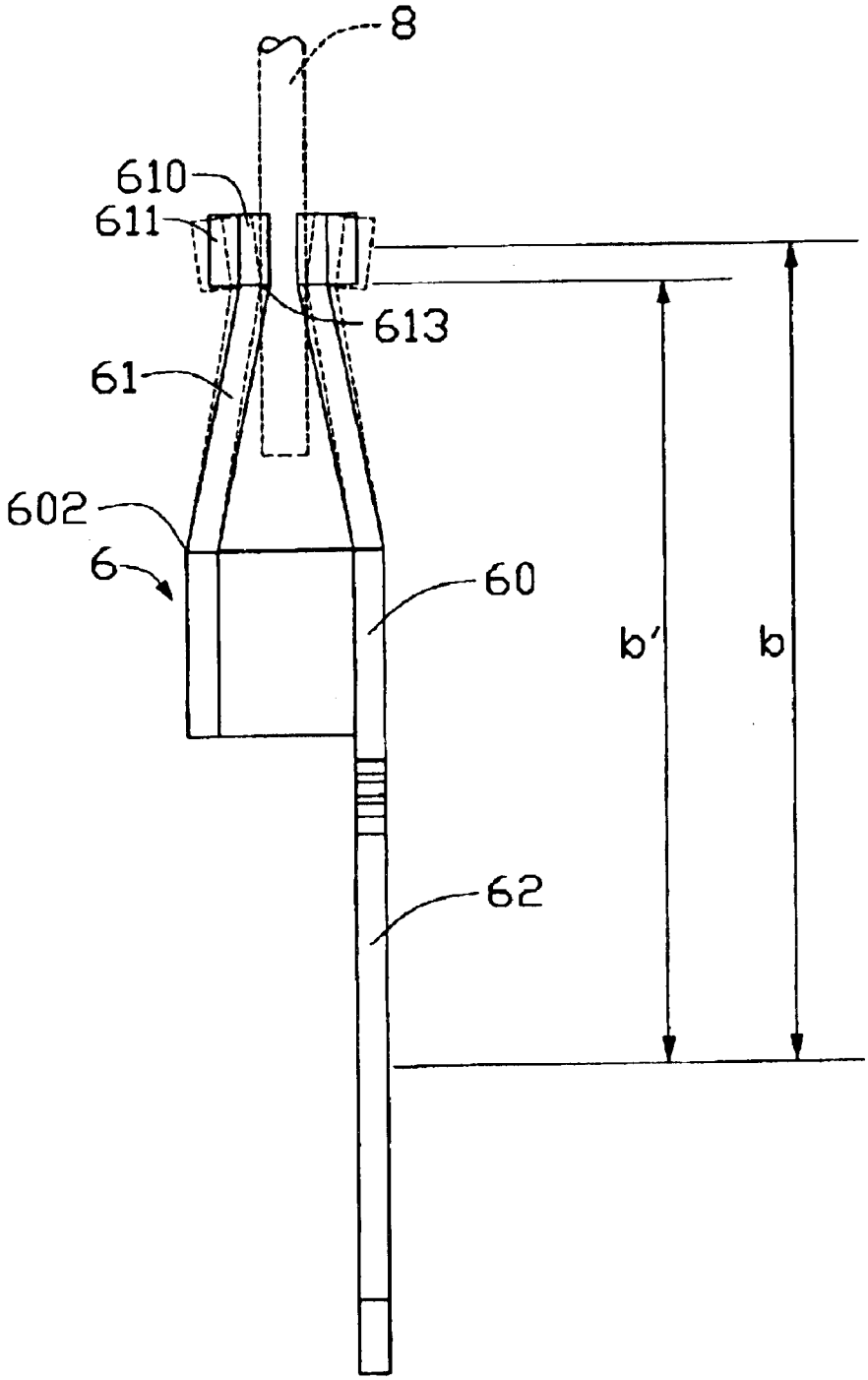
FIG. 4 (PRIOR ART)
FIG. 4 is a front side plan view of the electrical contact of FIG. 3, showing a corresponding mating pin (represented by broken lines) of a CPU engaging with the contact.

Referring particularly to FIG. 2, in use, the pin 2 is inserted into a space between the free ends of the guiding portions 111. The second distance is greater than a diameter of the pin 2. Accordingly, the pin 2 is inserted with zero insertion force as between the contact 1 and the pin 2, and each arm portion 11 remains in the rest position. Then the pin 2 is moved horizontally toward the contact portions 110. Opposite side portions of a leading periphery of the pin 2 eventually contact the convex sides 1112 of the guiding portions 111, whereupon an actuation force is applied to drive the pin 2 further. The arm portions 11 deflect outwardly with respect to the first lines 112 toward respective deflected positions. As can be seen from the broken lines of FIG. 2, when the pin 2 contacts the convex sides 1112 of the guiding portions 111, it contacts a medial contact point (not labeled) of each guiding portion 111 because each guiding portion 111 is convex. Further, when the pin 2 enters between the contact portions 110, it contacts a medial contact point 1100 of each contact portion 110 because each contact portion 110 is convex. The contact points (not labeled) of the guiding portions 111 and the contact points 1100 are all located above the corresponding bottom edges 1110. A radius of leverage corresponding to said actuation force is represented by 'c' in FIG. 2. The radius c is greater than the corresponding radius b' for the conventional contact 6 shown in FIG. 4. Thus, said actuation force required to drive the pin 2 into the contact 1 is less than that required for the conventional contact 6.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical contact for engaging with a transversely actuatable pin, the electrical contact comprising:

a medial portion having a U-shaped horizontal cross-section and comprising two parallel sidewalls and an engaging portion extending from a lower section of one of the sidewalls;

a pair of arm portions extending from an upper section of the sidewalls of the medial portion respectively and bending obliquely toward each other, each of the arm portions being deflectable from a rest position to a deflected position by the pin, each of the arm portions comprising a contact portion at an end thereof and a guiding portion extending obliquely from the contact portion, the guiding portion comprising an inner convex side and a bottom edge, tile contact portion comprising an inner convex side, wherein when each of the arm portions is deflected from the rest position to the deflected position, the pin contacts a contact section of the arm portion located above the bottom edge; and a solder portion extending from a lower section of the engaging portion of the medial portion.

2. The electrical contact as claimed in claim 1, wherein the engaging portion comprises a plurality of protrusions, for engaging with a base of an electrical connector.

3. An electrical connector adapted for electrically connecting a central processing unit (CPU) having a plurality of transversely actuatable pins with a printed circuit board (PCB), the electrical connector comprising:

an insulative base;

a plurality of contacts received in the base, each of the contacts comprising:

a medial portion comprising a pair of sidewalls parallel to each other, and an engaging portion depending from a bottom of one of the sidewalls;

a pair of arm portions each deflectable from a rest position to a deflected position by a corresponding pin, the arm portions extending from tops of the sidewalls respectively and bending obliquely toward each other, each of the arm portions comprising a contact portion at an end thereof and a guiding portion extending obliquely from an end of the contact portion, the guiding portion comprising an inner convex side and a bottom edge, the contact portion comprising an inner convex side, wherein when each of the arm portions is deflected from the rest position to the deflected position, the pin contacts a contact section of the arm portion located above the bottom edge; and a solder portion extending from a bottom of the engaging portion.

4. The electrical connector as claimed in claim 3, wherein the engaging portion of each of the contacts comprises a plurality of protrusions for engaging with the base.

5. An electrical contact assembly comprising:

a conductive contact defining a U-shaped medial portion;

a pair of arm portions integrally extending upwardly from upper portions of two parallel spaced side walls of said medial portion and bending obliquely toward each other;

a pair of contact portion located on top portions of the pair of arm portions, respectively, a pair of guiding portions horizontally and obliquely extending forwardly from the corresponding pair of contact portions, respectively, and defining therebetween a first space larger than a second space defined between the corresponding pair of contact portions;

at least said pair of contact portions being convexly coined toward each other along a horizontal direction thereof; and a pin moving between the pair of arm portions and along the guiding portions and the contact portions in a front-to-back direction to have the pair of arm portions outwardly deflected away from each other about fulcrums each located around a junction of the arm portion and the corresponding side wall; wherein engagement between the pin and the contact assuredly occurs only on the convexly coined contact portions rather than any other portions of the contact once the pin is moved to a final position between said pair of contact portions.

6. The electrical contact assembly as claimed in claim 5, wherein said pair of guiding portions are convexly coined toward each other along said horizontal direction to comply with said pair of contact portions.

7. The electrical contact assembly as claimed in claim 5, wherein said guiding portion is located at a same height with the corresponding contact portion.

* * * * *